US010407242B2

(12) United States Patent
Rimsa

(10) Patent No.: US 10,407,242 B2
(45) Date of Patent: Sep. 10, 2019

(54) REFUSE COLLECTION SYSTEM

(71) Applicant: Perkins Manufacturing Co., Bolingbrook, IL (US)

(72) Inventor: James Rimsa, Joliet, IL (US)

(73) Assignee: Perkins Manufacturing Co., Bolingbrook, IL (US)

( * ) Notice: Subject to any disclaimer, the term of this patent is extended or adjusted under 35 U.S.C. 154(b) by 1 day.

(21) Appl. No.: 15/784,717

(22) Filed: Oct. 16, 2017

(65) Prior Publication Data

US 2018/0037408 A1 Feb. 8, 2018

Related U.S. Application Data

(63) Continuation-in-part of application No. 15/379,716, filed on Dec. 15, 2016.

(Continued)

(51) Int. Cl.
*B65F 3/04* (2006.01)
*B65F 1/12* (2006.01)

(Continued)

(52) U.S. Cl.
CPC ..... *B65F 3/046* (2013.01); *B65F 1/122* (2013.01); *B65F 3/041* (2013.01); *B65F 1/1473* (2013.01); *B65F 1/1646* (2013.01); *B65F 2003/023* (2013.01); *B65F 2003/0276* (2013.01); *B65F 2003/0279* (2013.01)

(58) Field of Classification Search
CPC ..... B65F 3/041; B65F 3/046
See application file for complete search history.

(56) References Cited

U.S. PATENT DOCUMENTS 5,266,000 A * 11/1993 LeBlanc, Jr. ..... B65F 3/02 294/68.3
5,484,245 A 1/1996 Zopf (Continued)

OTHER PUBLICATIONS

Perkins Eco-Maxx Brochure, Automated Frontloader Can, 2 pages, Jun. 2016.

(Continued)

*Primary Examiner* — Jonathan Snelting
(74) *Attorney, Agent, or Firm* — Cook Alex Ltd.

(57) ABSTRACT

An intermediate container is provided for receiving refuse from a primary refuse container that is configured to be carried by a top-loading refuse collection vehicle lifter. The intermediate container comprises a front wall, a rear wall, opposed sidewalls, and a bottom wall defining a total refuse collection volume. An extension assembly that is configured for mounting a primary refuse collection container lifter thereon is located substantially beneath the total refuse collection volume intermediate the front wall and the rear wall, with a portion of the extension assembly being movable between a first, retracted position for storage and for dumping a primary refuse collection container and a second, extended position for engaging and releasing the primary refuse collection container at a location laterally spaced from the intermediate container refuse collection vehicle. Further, the intermediate container is free of fork receivers and includes at least one mounting member for non-destructive removable attachment to the collection vehicle lifter.

19 Claims, 21 Drawing Sheets

Related U.S. Application Data

(60) Provisional application No. 62/437,379, filed on Dec. 21, 2016, provisional application No. 62/271,089, filed on Dec. 22, 2015.

(51) Int. Cl.

| | |
|---|---|
| *B65F 1/16* | (2006.01) |
| *B65F 3/02* | (2006.01) |
| *B65F 1/14* | (2006.01) |

(56) References Cited

U.S. PATENT DOCUMENTS

| | | | | |
|---|---|---|---|---|
| 5,607,277 | A | 3/1997 | Zopf | |
| 5,639,201 | A * | 6/1997 | Curotto | B65F 1/122 294/86.4 |
| 5,797,715 | A | 8/1998 | Christenson | |
| 5,833,428 | A * | 11/1998 | Szinte | 414/408 |
| 5,938,394 | A | 8/1999 | Christenson | |
| 6,139,244 | A | 10/2000 | VanRaden | |
| D488,900 | S * | 4/2004 | Grange | D34/3 |
| 7,273,340 | B2 * | 9/2007 | Arrez | B65F 3/041 414/421 |
| 7,390,159 | B2 | 6/2008 | Rimsa et al. | |
| 7,871,233 | B2 | 1/2011 | Arrez et al. | |
| 2007/0243050 | A1 | 10/2007 | Arrez et al. | |
| 2010/0322749 | A1 | 12/2010 | Rowland et al. | |
| 2011/0038697 | A1 | 2/2011 | Arrez et al. | |
| 2017/0349373 | A1 | 12/2017 | Gentry et al. | |

OTHER PUBLICATIONS

Perkins Eco-Maxx III Brochure, Automated Carry Can, 2 pages, Jun. 2017.

* cited by examiner

REFUSE COLLECTION SYSTEM

FIELD OF THE DISCLOSURE

The present application relates to a refuse collection system and components thereof, and more particularly to a refuse collection system including an automated front load collection container and a convertible mounting system for removably securing the collection container to the lift arms of a top loading refuse collection vehicle.

BACKGROUND

Front load refuse collection vehicles are in wide use in large-scale residential refuse collection. A front load refuse collection vehicle typically has a front cab, a large refuse collection compartment or cavity behind the cab having an upper opening for receiving refuse, and a pair of hydraulic-powered lift arms that carry forks that extend in front of the vehicle, the forks being adapted to be inserted into corresponding slots or sleeves (also sometimes called fork pockets or fork apertures) associated with an intermediate portable refuse collection container. The forks are able to lift the refuse container over the front of the vehicle and invert the container to dump its contents into the refuse compartment or body located behind the cab. For purposes of this description, the general term fork "receiver" will be used to refer fork-receiving sleeves, slots, pockets, apertures and other structures associated with a container for cooperating with the forks to allow lifting and inversion of the container.

For residential and small-scale refuse collection, the collection container is carried in front of the collection vehicle as it moves along the street. The contents of smaller residential collection carts (i.e., "primary" refuse collection containers) are first dumped into the intermediate collection container to fill the intermediate container, and the intermediate container is then inverted to dump its contents into a larger collection bin behind the vehicle cab.

Typically a hydraulic cart lifter is mounted to the intermediate collection container to grasp and invert the residential collection cart to dump its contents into the intermediate container. Hydraulic lifters also have been mounted to the intermediate collection container in a manner so that the lifter can be moved laterally relative to the intermediate container into engagement with the residential refuse cart for curb-side collection, without requiring the operator to move the refuse receptacle to the lifter. U.S. Pat. Nos. 5,484,245; 5,639,201; 5,797,715; and 6,139,244, all of which are hereby incorporated by reference, illustrate such arrangements. The present application is directed presents a new and unique arrangement, offering particular versatility for emptying, intermediate containers not found on prior systems.

SUMMARY OF THE DISCLOSURE

There are several aspects of the present subject matter that may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In a first aspect, an intermediate container is provided for receiving refuse from a primary refuse container, and configured to be carried by a top-loading refuse collection vehicle having first and second lift arms pivotally attached to opposite sides of the refuse collection vehicle. The intermediate container comprises a front wall, a rear wall, opposed sidewalls, and a bottom wall defining a total refuse collection volume.

An extension assembly is positioned substantially beneath the total refuse collection volume intermediate the front wall and the rear wall, with a portion of the extension assembly being configured for mounting a primary refuse collection container lifter thereon and being movable between a first, retracted position for storage and for dumping a primary refuse collection container and a second, extended position for engaging and releasing the primary refuse collection container at a location laterally spaced from the intermediate container refuse collection vehicle.

The intermediate container is free of fork receivers, and includes first and second mounting members permanently secured to the opposed sidewalls for attachment to first and second lift arms of the refuse collection vehicle. Each of the first and second mounting members extending rearwardly of the rear wall of the container and has an elongated cylindrical member secured thereto so that the intermediate container can be rotatably mounted to the first and second lift arms of the refuse collection vehicle.

In a related aspect, each of the first and second mounting members comprises and elongated, planar arm secured to its respective sidewall of the intermediate container. In a preferred embodiment, each planar arm includes a portion that extends to the rear wall of the intermediate container and comprises a side wall of a box section that extends rearwardly of the rear wall of the intermediate container and through which the elongated cylindrical member extends. Additionally, each box section comprises a top wall, a bottom wall, and a plurality of side walls.

In a further aspect, the intermediate container further comprises a primary refuse collection container lifter secured to the extension member, with the primary refuse collection container lifter comprising an actuator having a single central idler arm.

DETAILED DESCRIPTION

The embodiments disclosed herein are for the purpose of providing an exemplary description of the present subject matter. They are, however, only exemplary, and the present subject matter may be embodied in various forms.
Therefore, specific details disclosed herein are not to be interpreted as limiting the subject matter as defined in the accompanying claims.

Figure 1:
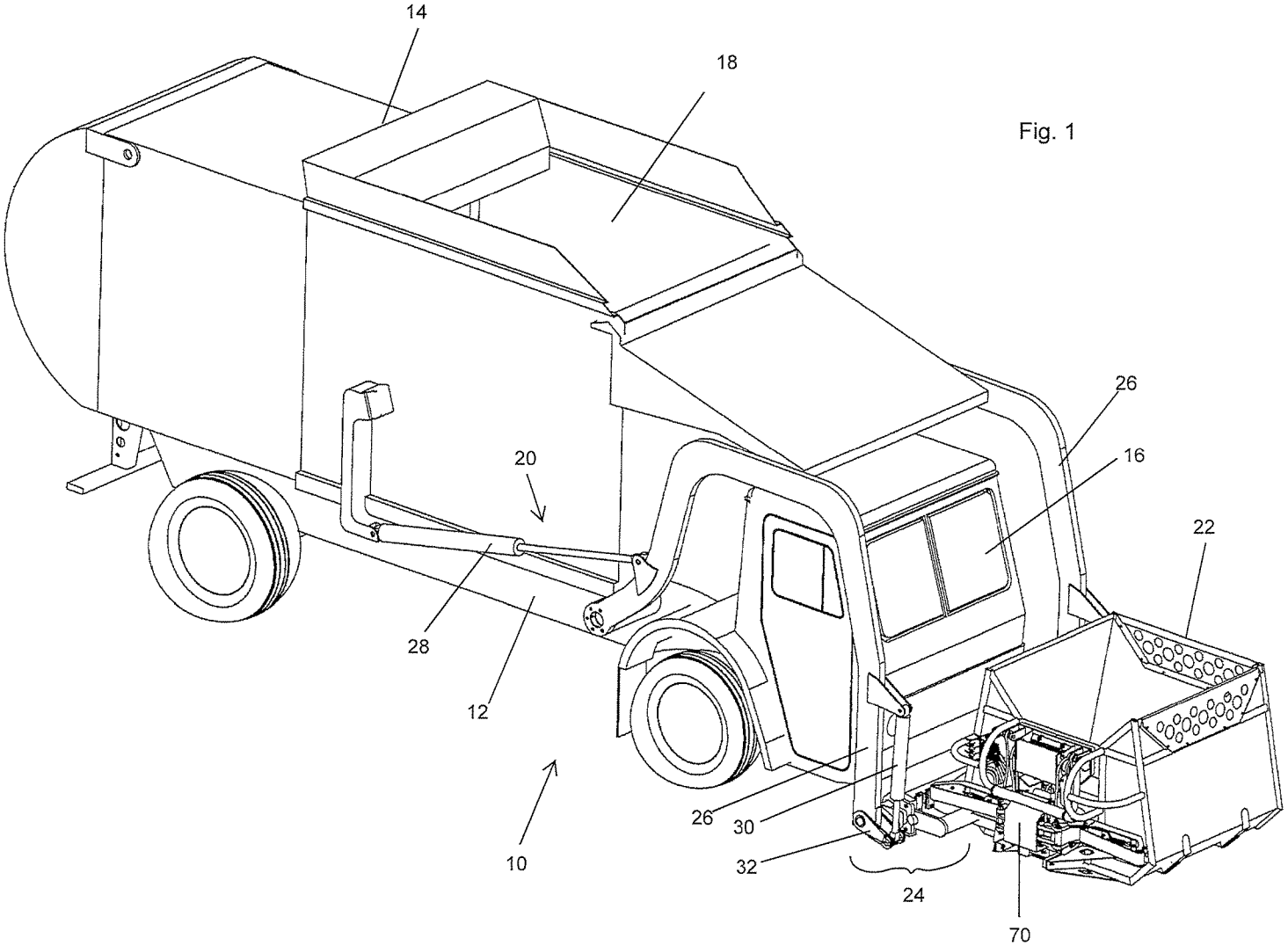
FIG. 1 is a perspective view of a refuse collection vehicle and an intermediate front load collection container having a convertible mounting system in accordance with the present disclosure.
Figure 2:
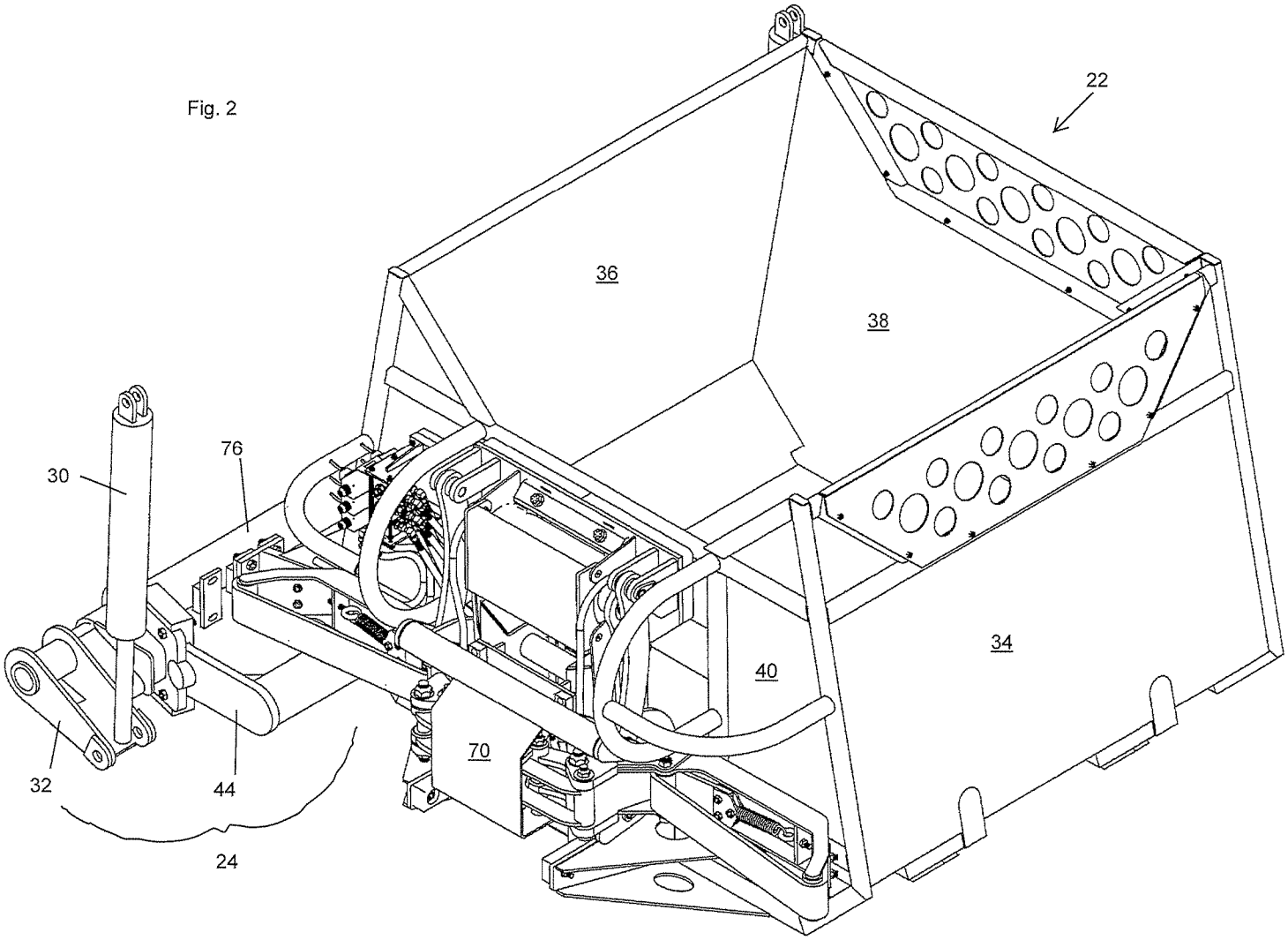
FIG. 2 is an enlarged perspective view of the intermediate front load collection container having a convertible mounting system of FIG. 1 showing the collection container mounted to the lift arms of the refuse collection vehicle.
Figure 3:
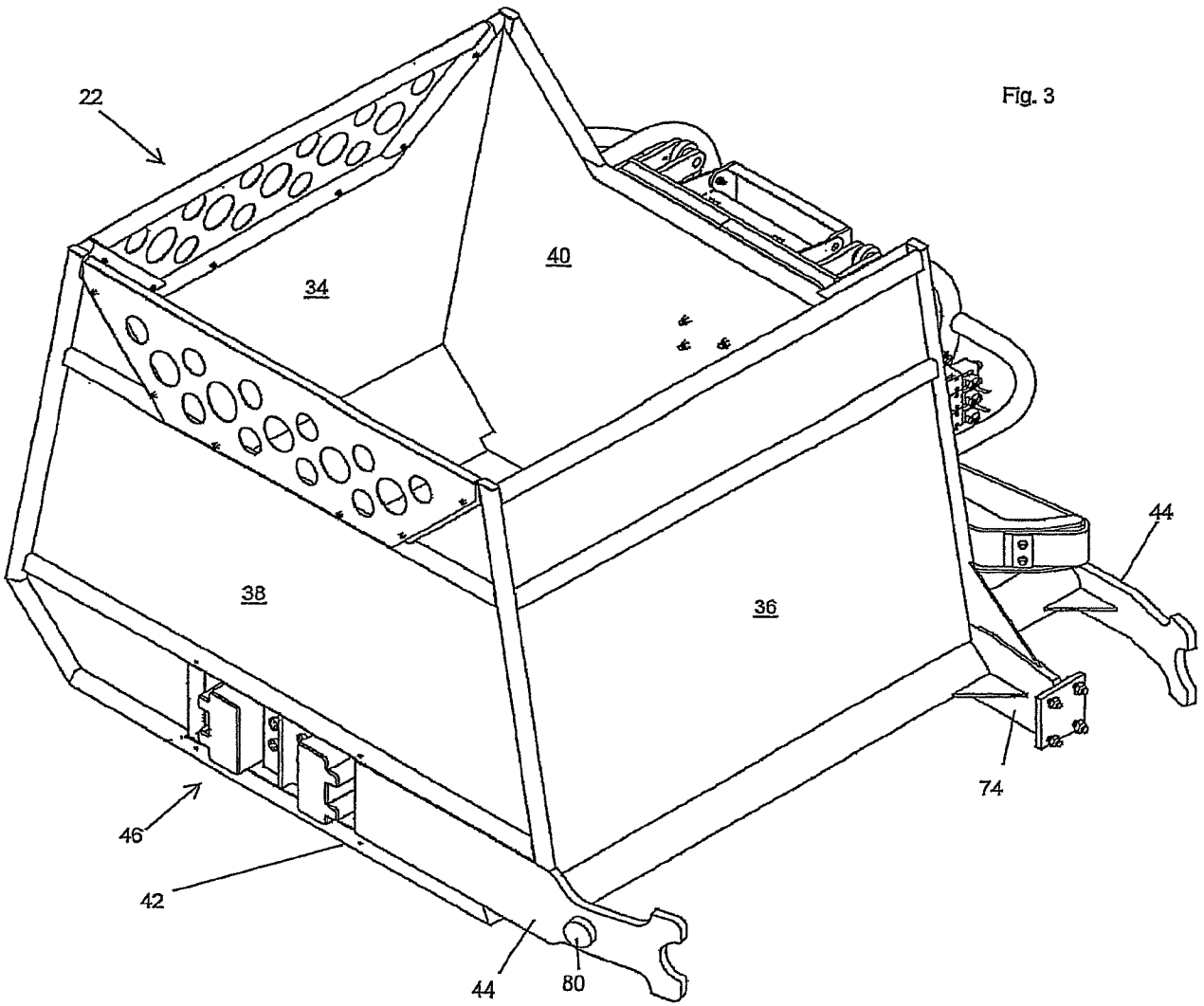
FIG. 3 is an enlarged perspective view of the intermediate front load collection can having a convertible mounting system of FIG. 2 separate from the lift bar of the refuse collection vehicle.
Figure 4:
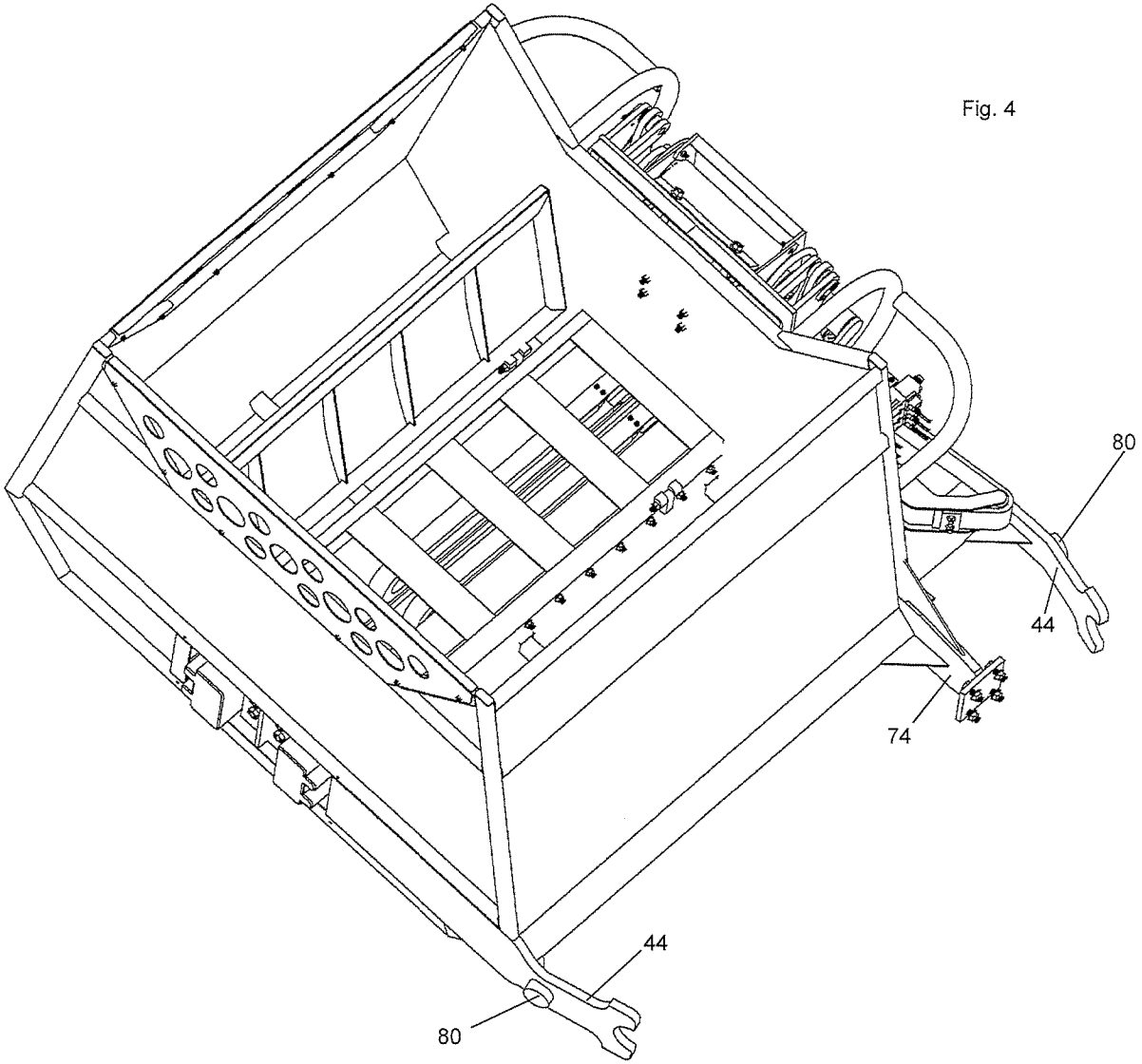
FIG. 4 is an enlarged perspective view of the intermediate front load collection container having a convertible mounting system similar to FIG. 3, but from a different angle, so as to show some of the interior of the collection container, including the slide system for moving the primary refuse collection container lifter laterally from the refuse collection vehicle.
Figure 10:
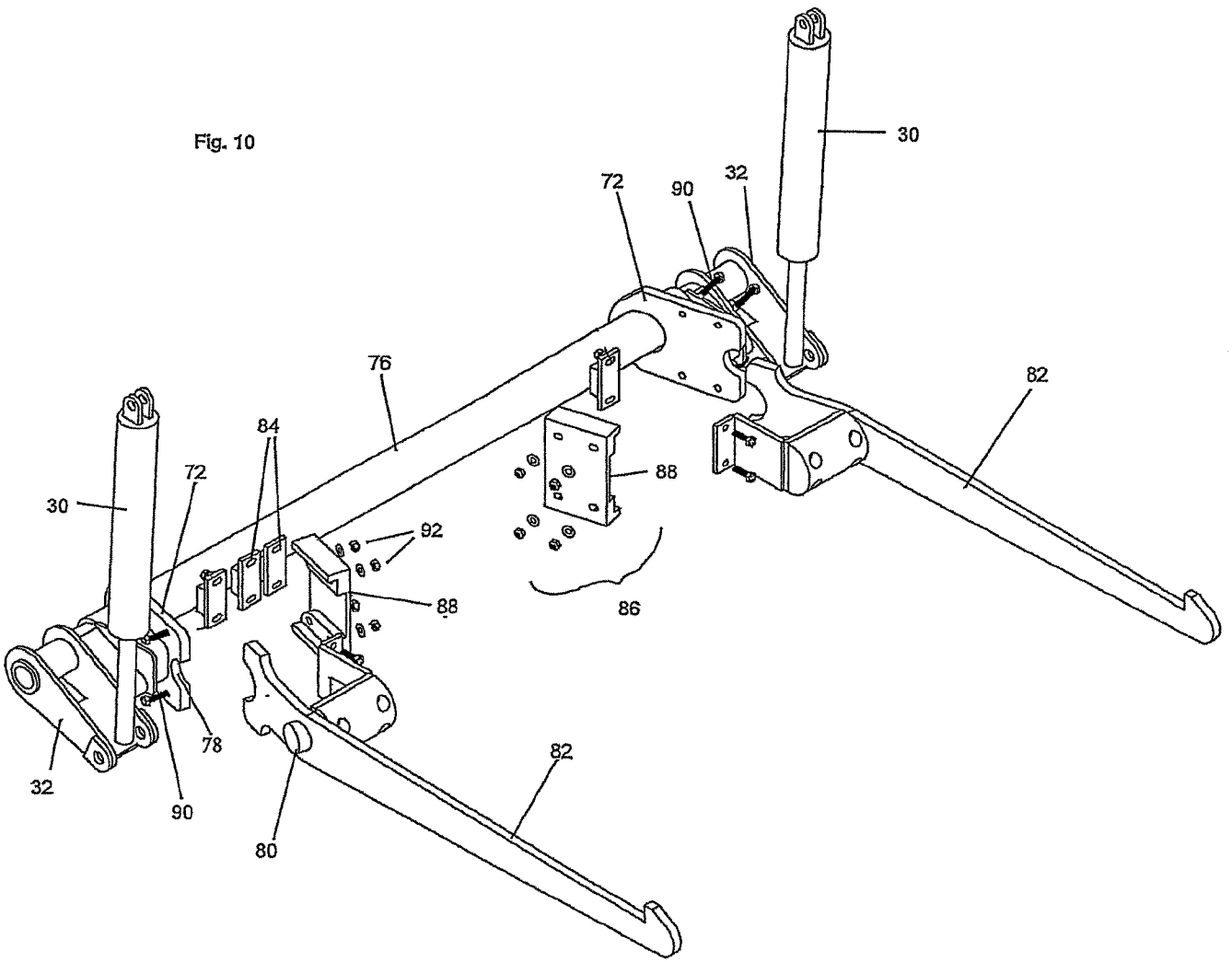
FIG. 10 is an exploded perspective view showing the convertible mounting system in combination with lift forks configured for lifting a standard, fork mounted intermediate front load collection can of the type having fork receivers.
Figure 11B:
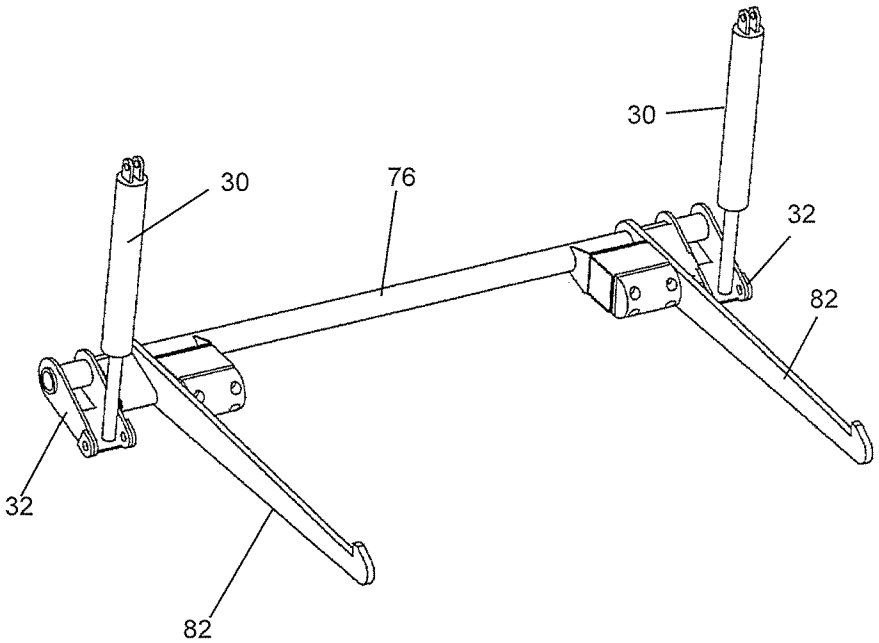
FIGS. 11A and 11B are perspective views of the convertible fork mounting system according to the present disclosure for mounting an intermediate container as described herein (FIG. 11A) and for having a pair of forks mounted thereto (FIG. 11 B).
Figure 11A:
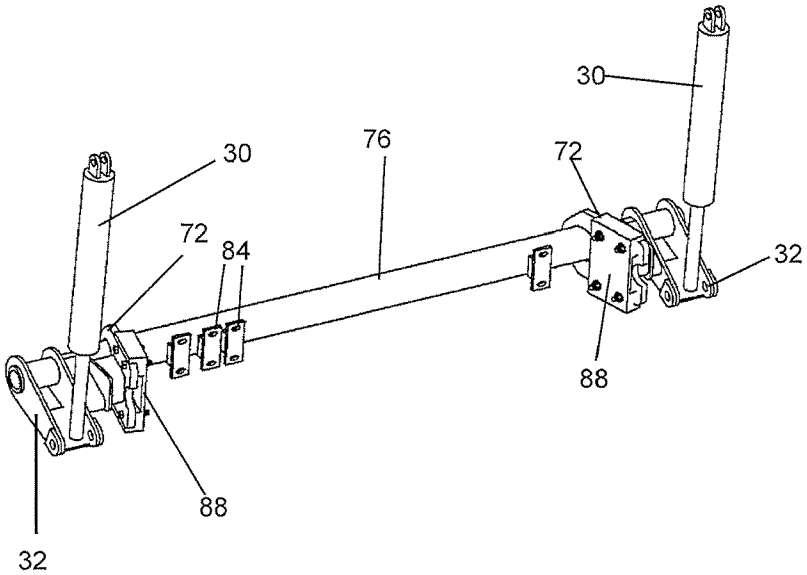
Figure 12:
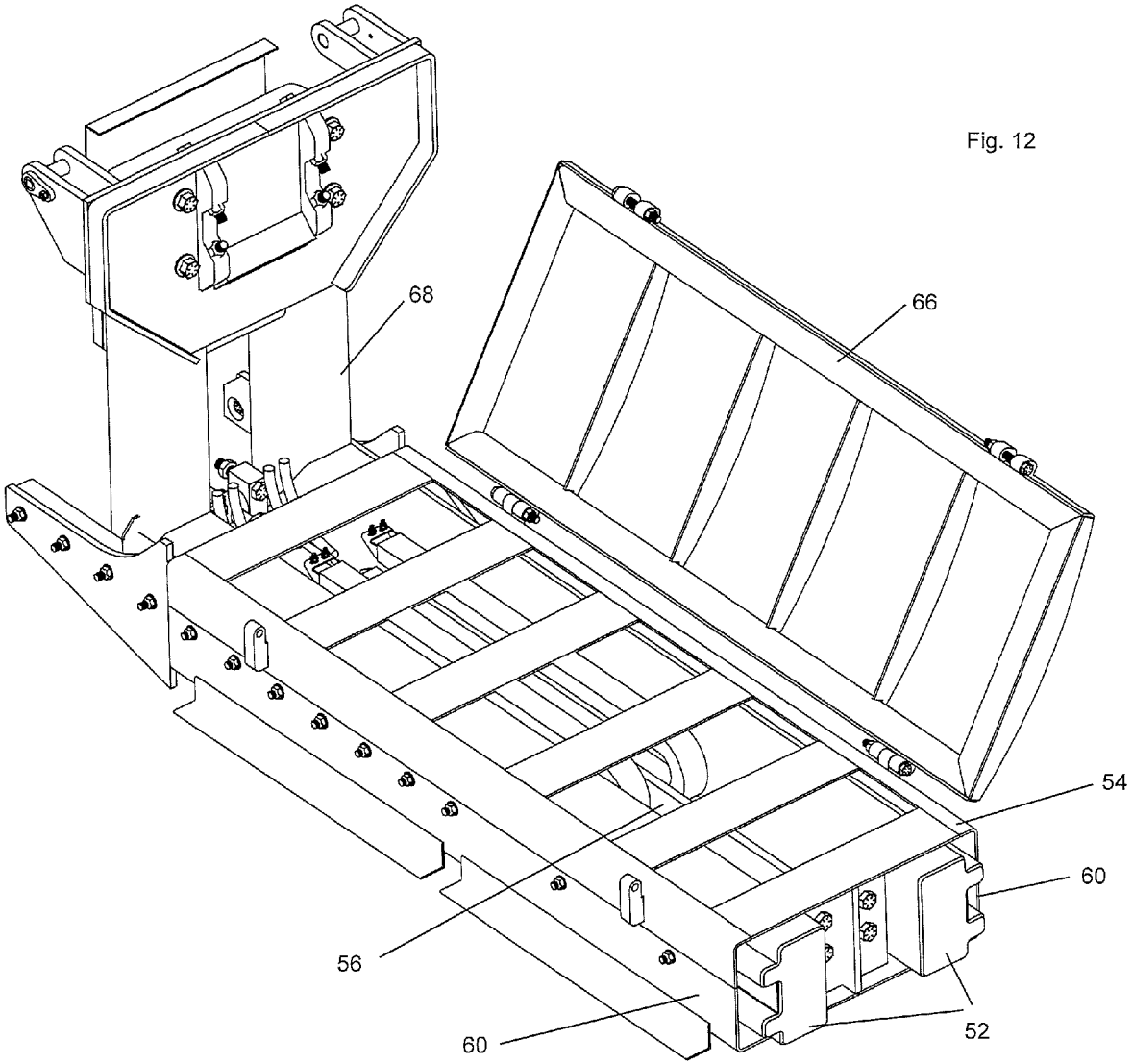
FIG. 12 is a perspective view of the slidable mounting system for supporting a lifter (with the lifter omitted to show details), including a track having a side frame configured to be secured to the bottom wall of the refuse collection container that slidably receives a slide that includes on one end the mount to which the lifter is to be affixed, and a hood/lid attached by, e.g., hinges, to permit access to an extension cylinder for moving the slide back and forth along the track.

With reference to FIG. 1, there is seen a refuse collection system, generally designated 10, embodying various aspects of the present disclosure, namely a top loading refuse collection vehicle 12 having a large refuse collection compartment or hopper 14 behind the cab 16 and having an upper opening 18 for receiving refuse and including a lift mechanism 20, an intermediate refuse collection container 22, and a mounting system 24 (better seen in FIGS. 10, 11A and 11B).

The lift mechanism 20 includes a pair of lift arms 26 pivotally attached to opposite sides of the body of the collection vehicle 12, such that the lift arms 26 carry the mounting system 24. An actuator 28 is pivotally attached to each lift arm 26 for moving the lift arms 26 between a first position, in which the intermediate container is carried upright in front of the collection vehicle 12 (as shown in FIG. 1), and a second position in which the intermediate container 22 is inverted for dumping its contents into the opening 18 of the hopper 14 (not shown).

As described in greater detail below, the mounting system 24 is convertible to permit its use with either intermediate collection containers that have fork receivers (not shown in FIG. 1), or intermediate collection containers that do not have such fork receivers (such as the intermediate collection container described herein). The mounting system 24 is pivotally mounted to the ends of the lift arms 26, with an actuator 30 interposed between each lift arm 26 and a pivot arm 32 associated with the mounting system 24 for rotating the mounting system 24 between a first, forward facing position (in which forks associated with the mounting system would extend forwardly for insertion and receipt in the fork receivers of an intermediate container) and a second generally-upward facing position (in which forks associated with the mounting system would extend generally vertically for storage or during vehicle movement in the absence of an intermediate container).

The intermediate container 22 comprises a front wall 34, a rear wall 36, opposed sidewalls 38, 40, and a bottom wall 42 so as to define a total refuse collection volume. The intermediate container 22 is free of fork receivers but instead includes one or more mounting members 44 for non-destructive removable attachment of the collection container 22 to the collection vehicle lift mechanism 20.

Figure 5:
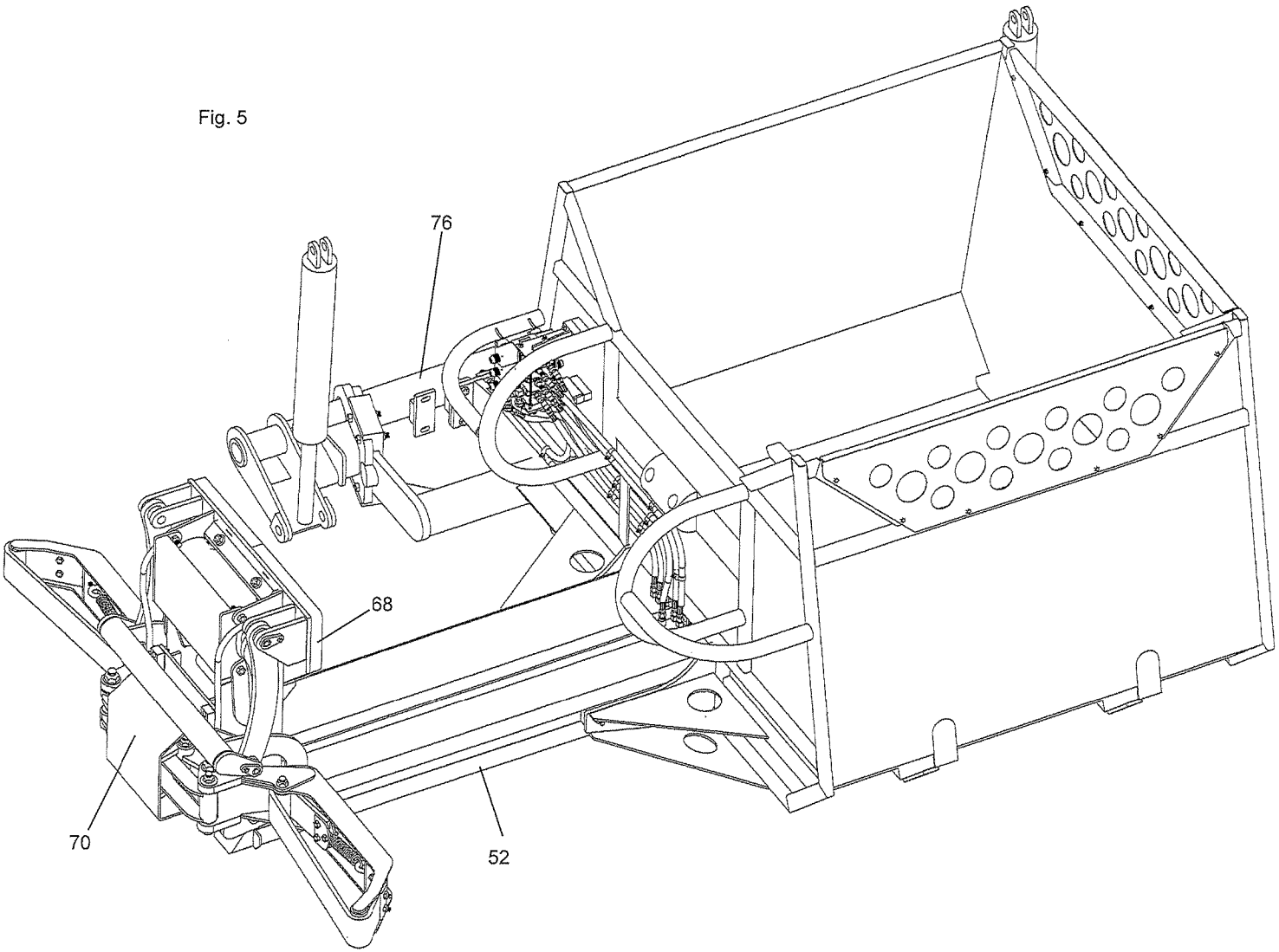
FIG. 5 is an enlarged perspective view of the intermediate front load collection container having a convertible mounting system similar to FIG. 2 showing the collection container mounted to the lift arms of the refuse collection vehicle and with the primary refuse collection container lifter spaced laterally from the intermediate collection container for engaging or disengaging a primary refuse collection container.
Figure 6:
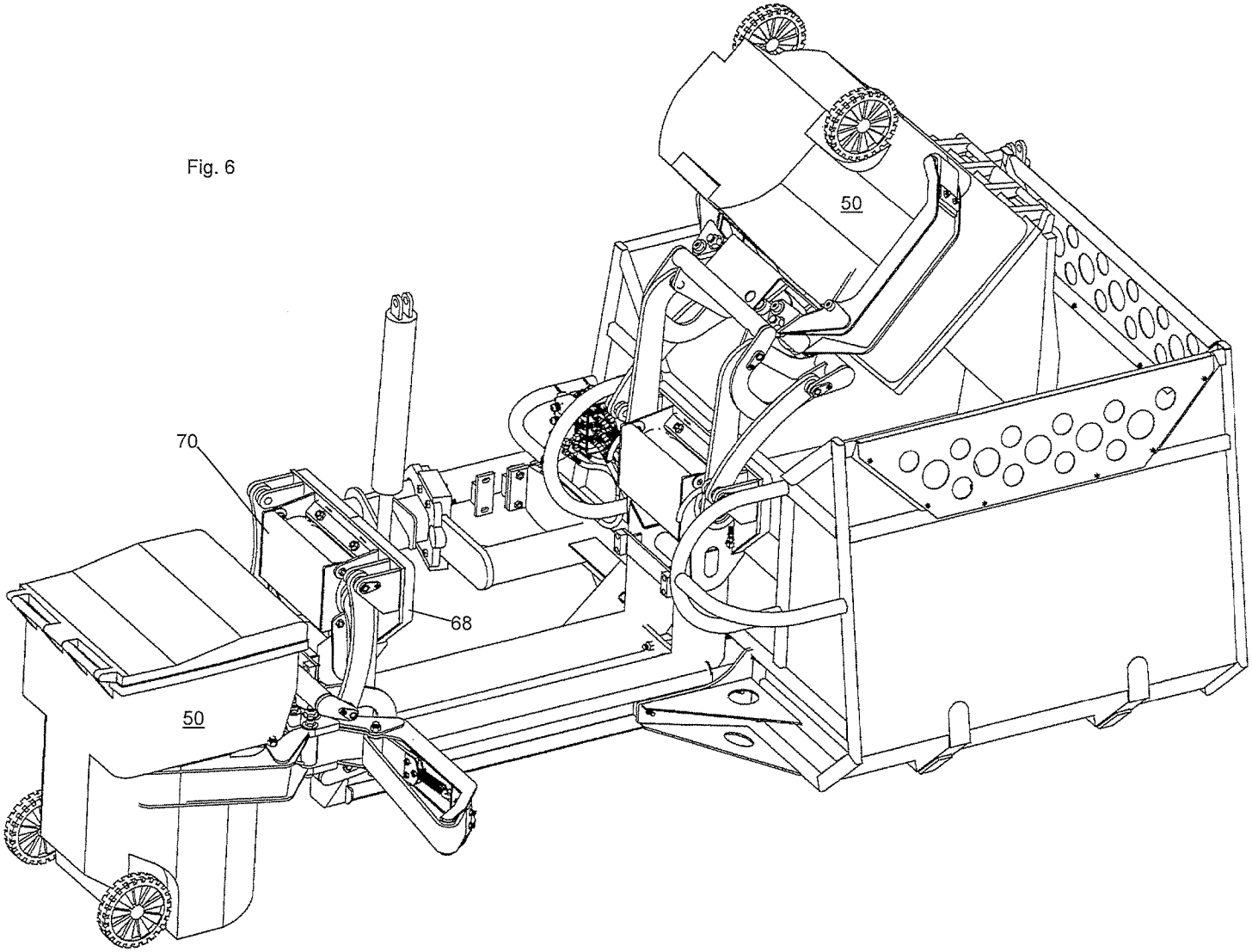
FIG. 6 is a perspective view similar to FIG. 5 showing the primary refuse collection container lifter in both a laterally-spaced position for engaging/disengaging a primary refuse collection container, and in a retracted, dumping position in which the primary refuse collection container is inverted by the lifter for dumping its contents into the intermediate front load collection container.
Figure 7:
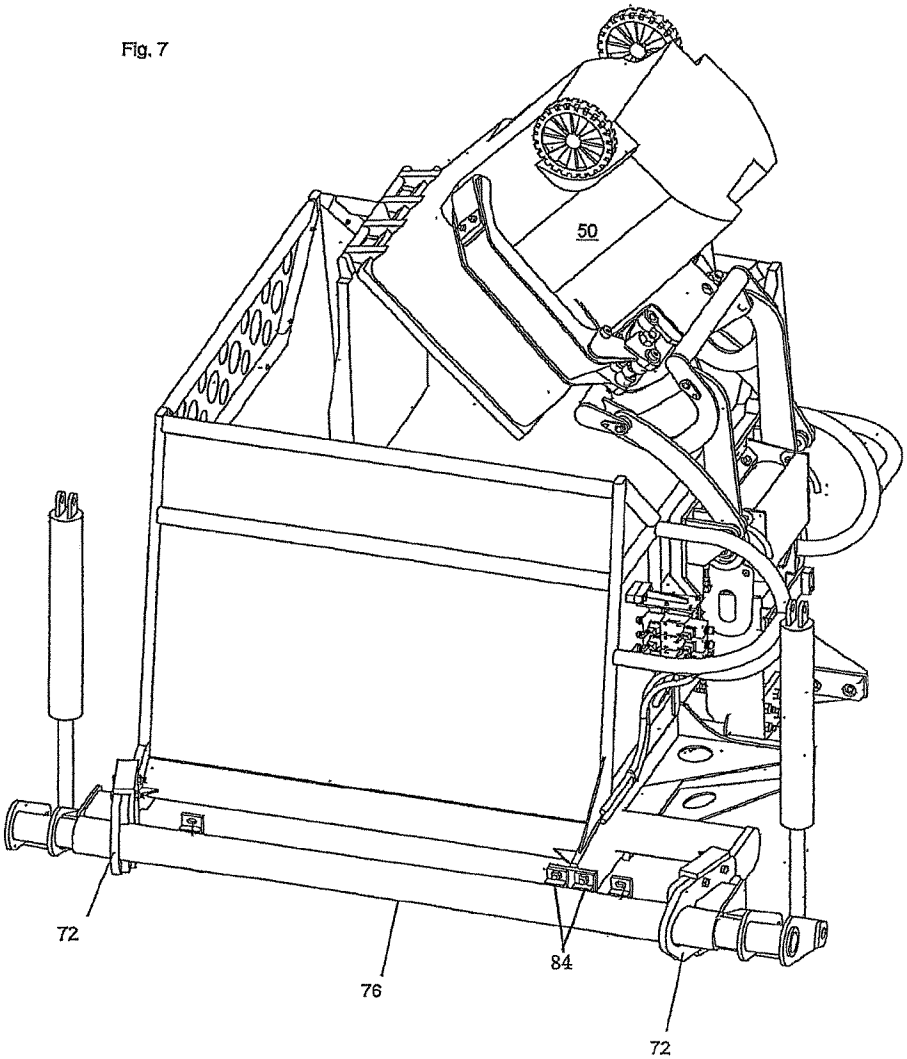
FIG. 7 is a perspective view showing the primary refuse collection container lifter in a retracted, dumping position in which the primary refuse collection container is inverted by the lifter for dumping its contents into the intermediate front load collection container.
Figure 8:
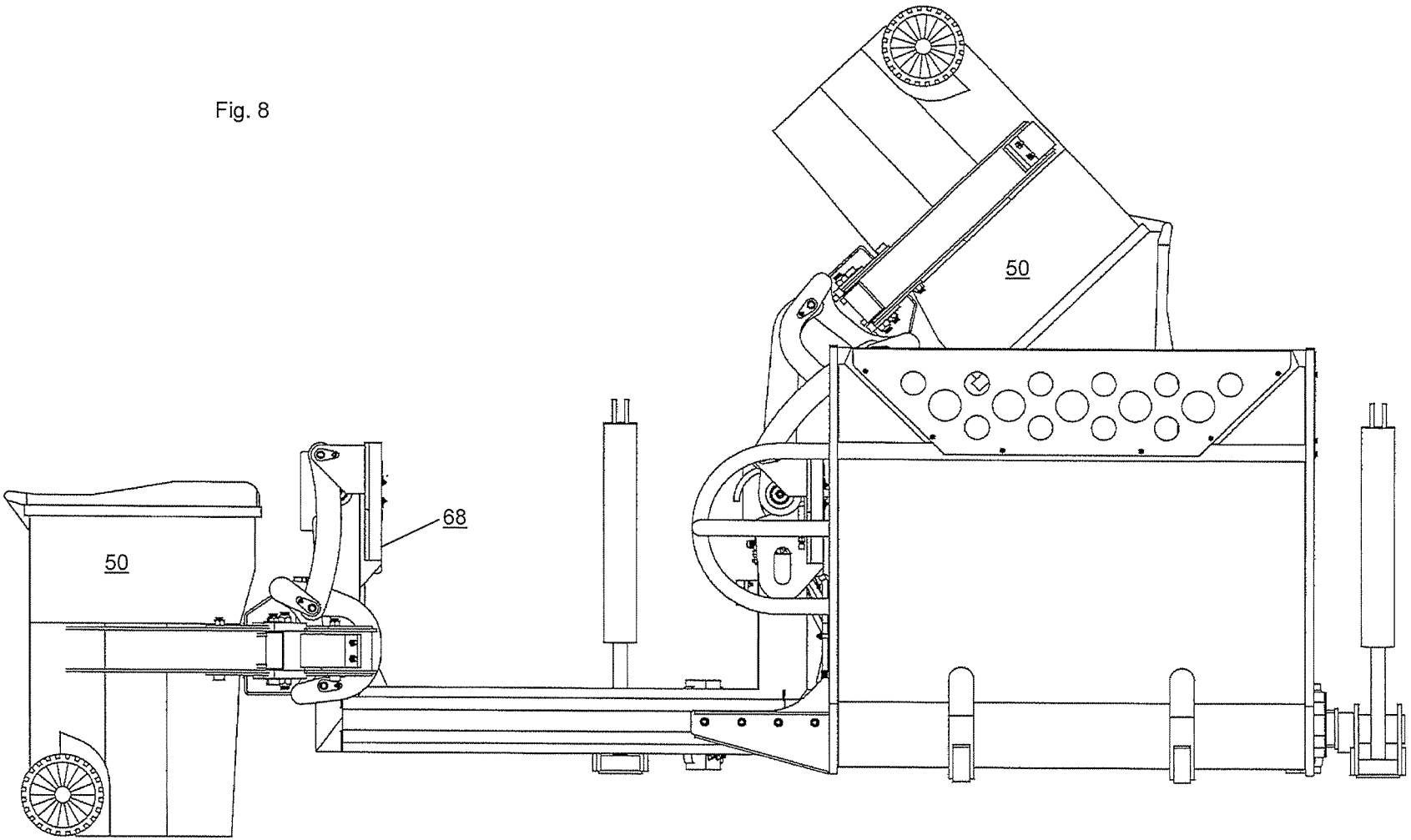
FIG. 8 is a front view similar to FIG. 6 showing the primary refuse collection container lifter in both a laterally-spaced position for engaging/disengaging a refuse collection container, and in a retracted, dumping position in which the primary refuse collection container is inverted by the lifter for dumping its contents into the intermediate front load collection container.
Figure 9:
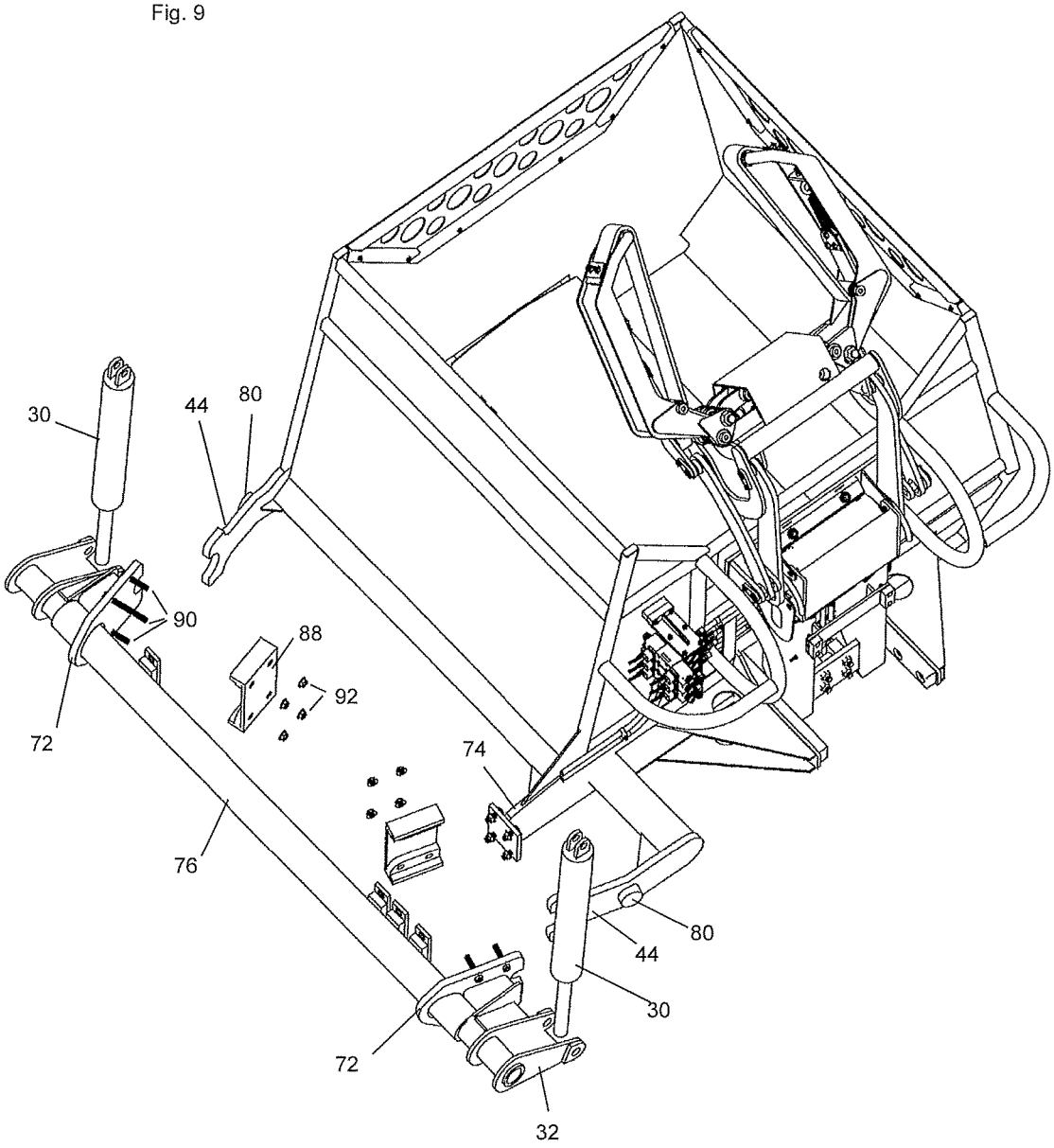
FIG. 9 is an exploded perspective view showing the intermediate front load collection container spaced from the cross or lift bar to which it is to be attached and better showing the convertible mounting system.

An extension assembly, generally designated 46, is positioned substantially along or beneath the bottom wall of the intermediate container, such as beneath the total refuse collection volume intermediate the front wall 34 and the rear wall 36, with a portion of the extension assembly 46 being movable between a first, retracted position (shown in, e.g., FIGS. 1-4) for storage and for dumping a primary refuse collection container 50, and a second, extended position (shown, e.g., in FIG. 5) for engaging and releasing the primary refuse collection container at a location laterally spaced from the intermediate container 22 and the refuse collection vehicle 12.

As illustrated, the extension assembly 46 includes a rigid extension member 52 and a track assembly 54 carried by the container 22 that cooperates with the rigid extension member 52 to allow lateral reciprocal movement of the rigid extension member 52 relative to the side wall 40 of the container 22. An actuator 56, such as a hydraulic cylinder, is provided for moving the rigid extension member 52 back and forth along the track 54.

Figure 13:
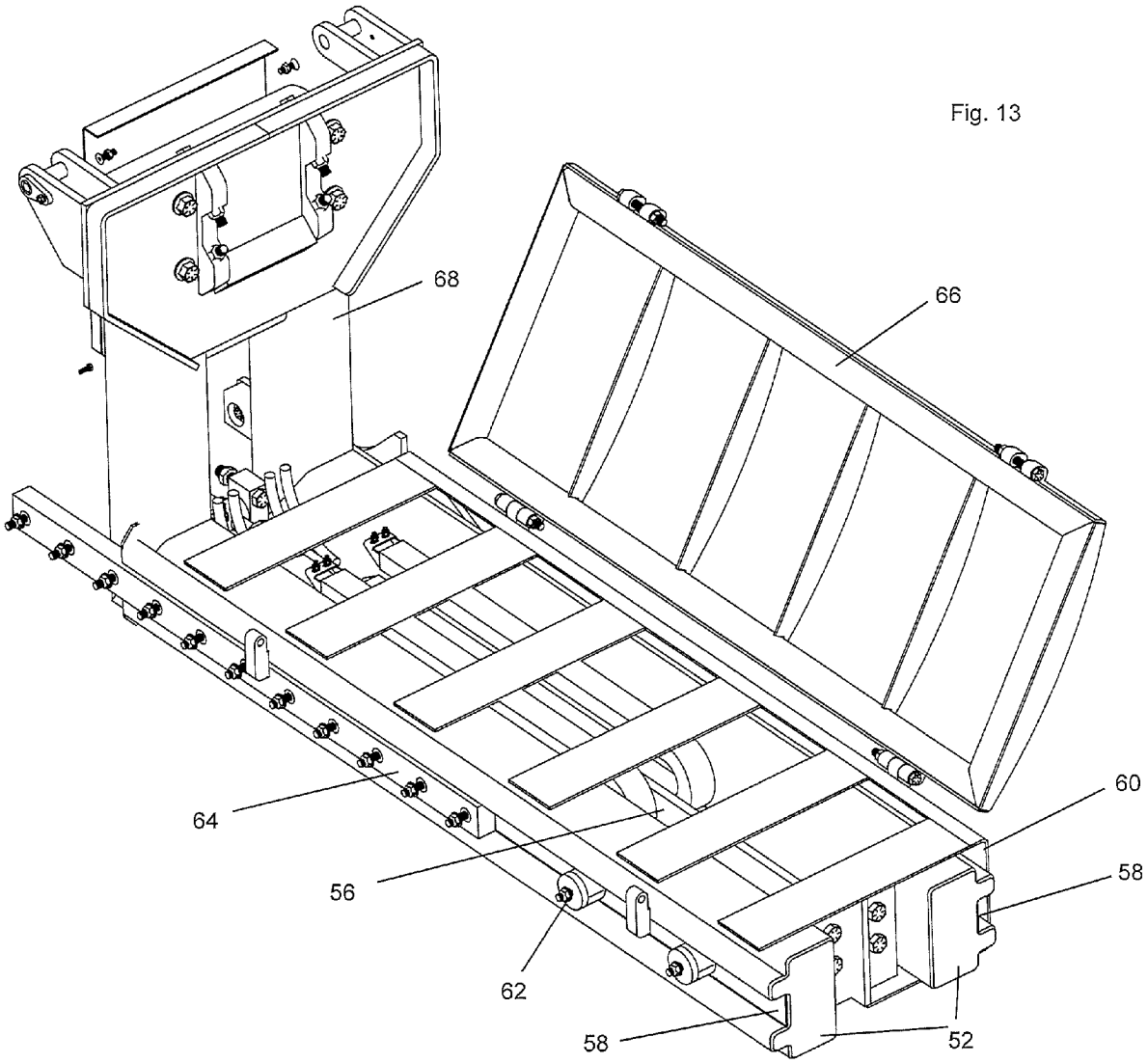
FIG. 13 is a perspective view similar to FIG. 12 with portions of the track removed to show detail.
Figure 14:
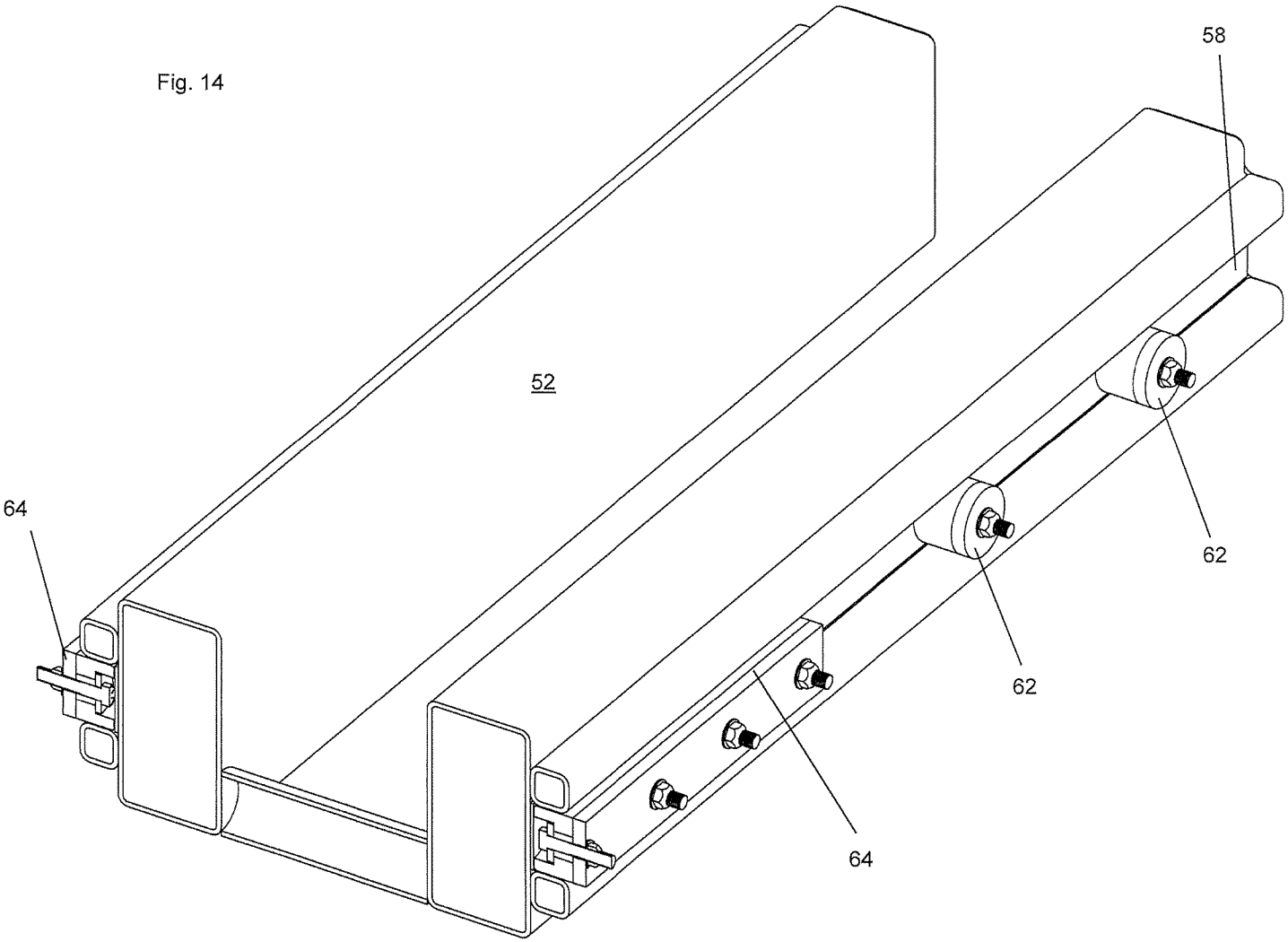
FIG. 14 is a fragmentary perspective view showing the slide and a cooperating portion of the track that is received in a channel in the slide.
Figure 15:
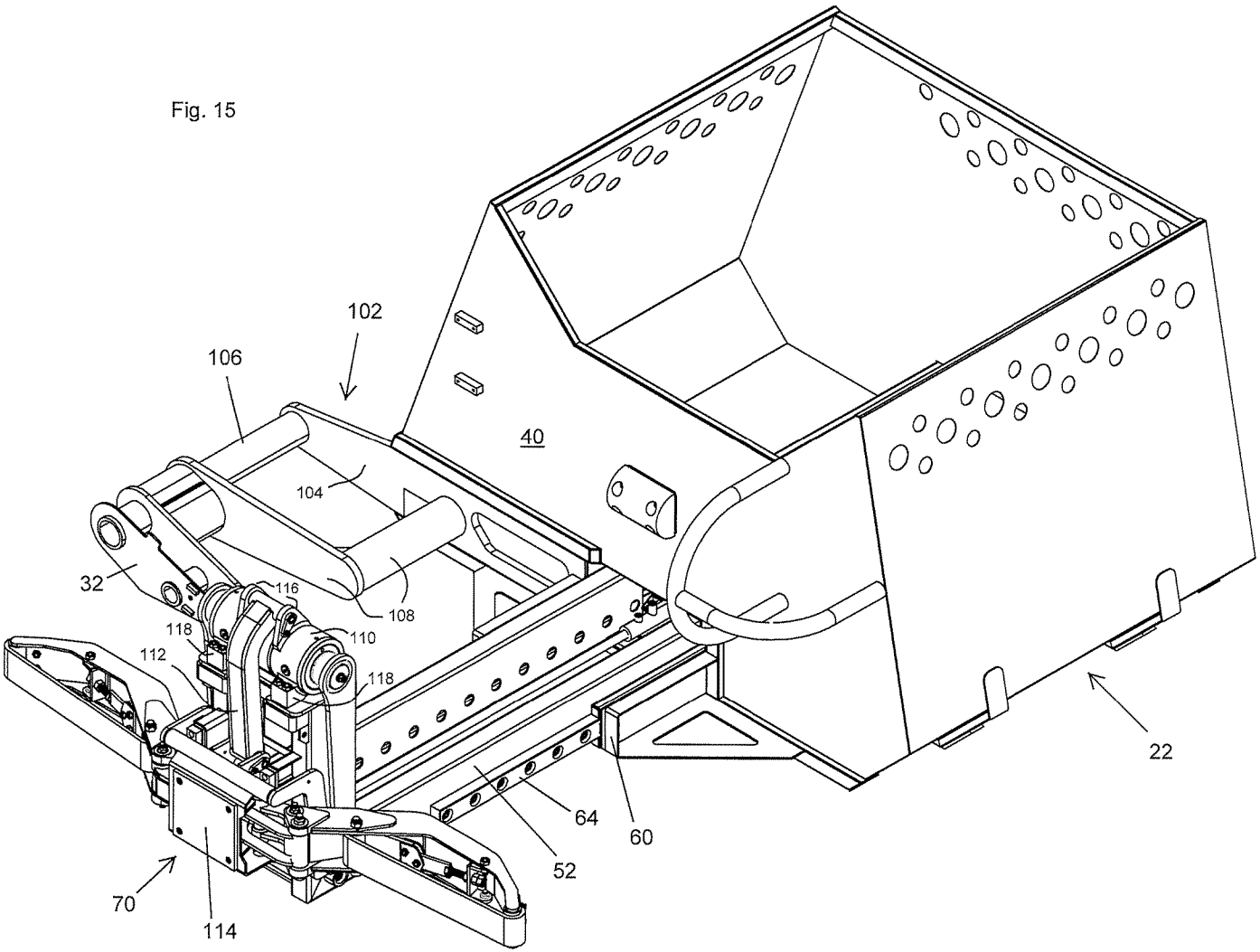
FIG. 15 is a front perspective view of a second embodiment of an intermediate container having an alternative structure for removably securing the intermediate container to the lift arms of a refuse collection vehicle, showing the primary refuse collection container lifter spaced laterally from the intermediate collection container for engaging or disengaging a primary refuse collection container.
Figure 16:
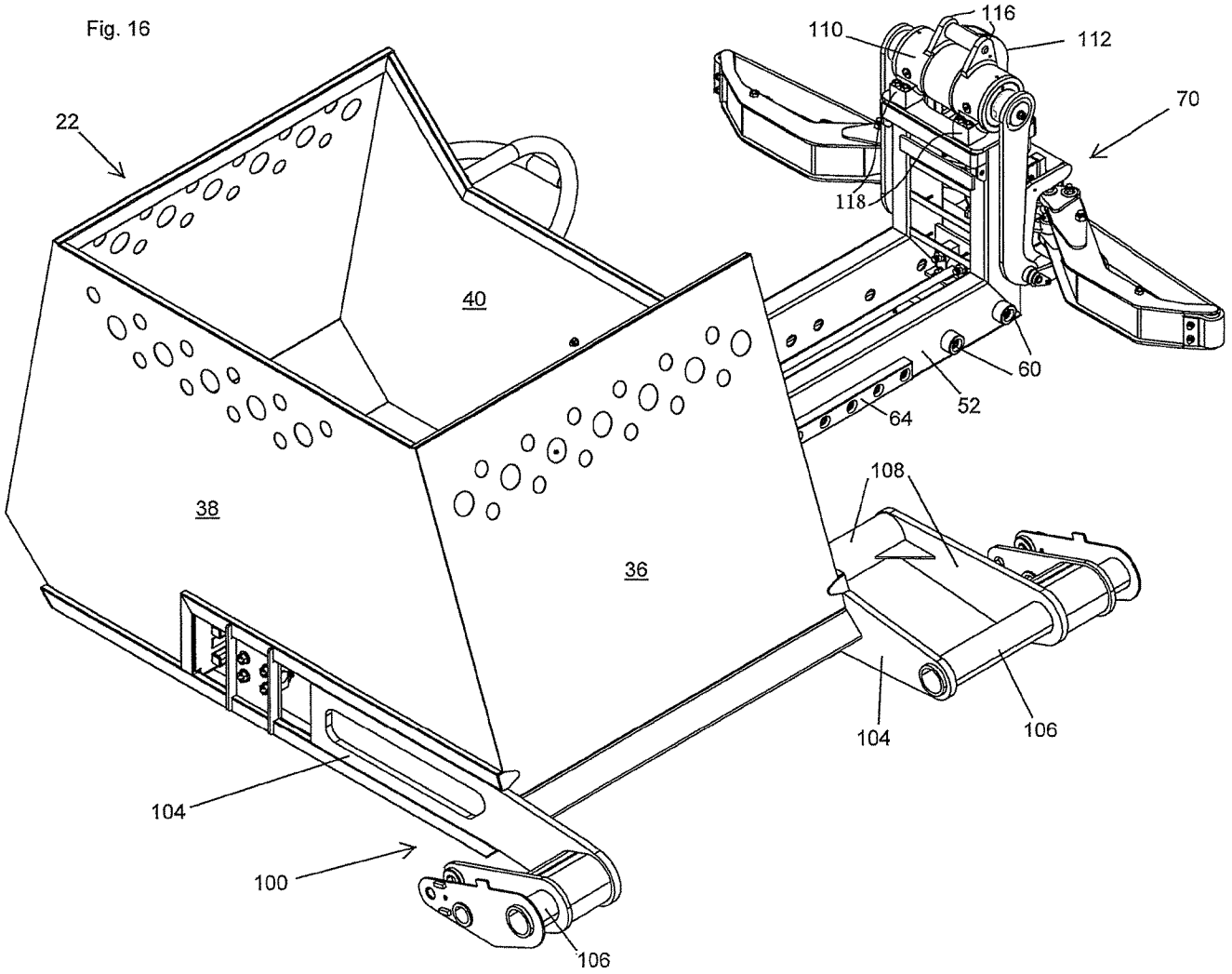
FIG. 16 is a rear perspective view of the embodiment of FIG. 15, also showing the primary refuse collection container lifter spaced laterally from the intermediate collection container for engaging or disengaging a primary refuse collection container.
Figure 17:
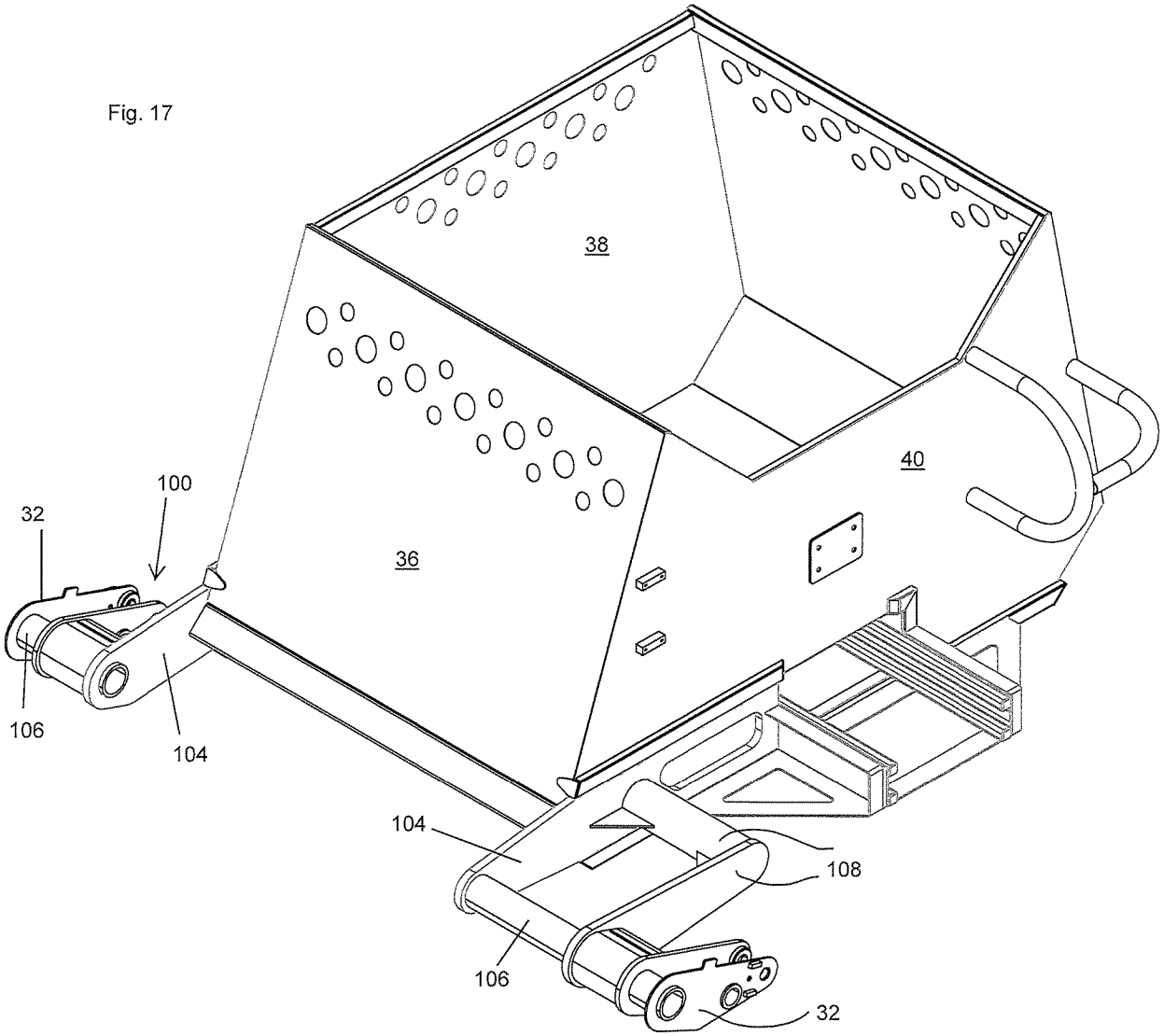
FIG. 17 is a rear perspective view of the embodiment of FIG. 15 with the primary refuse collection container lifter and its associated slide assembly removed to show detail.
Figure 18:
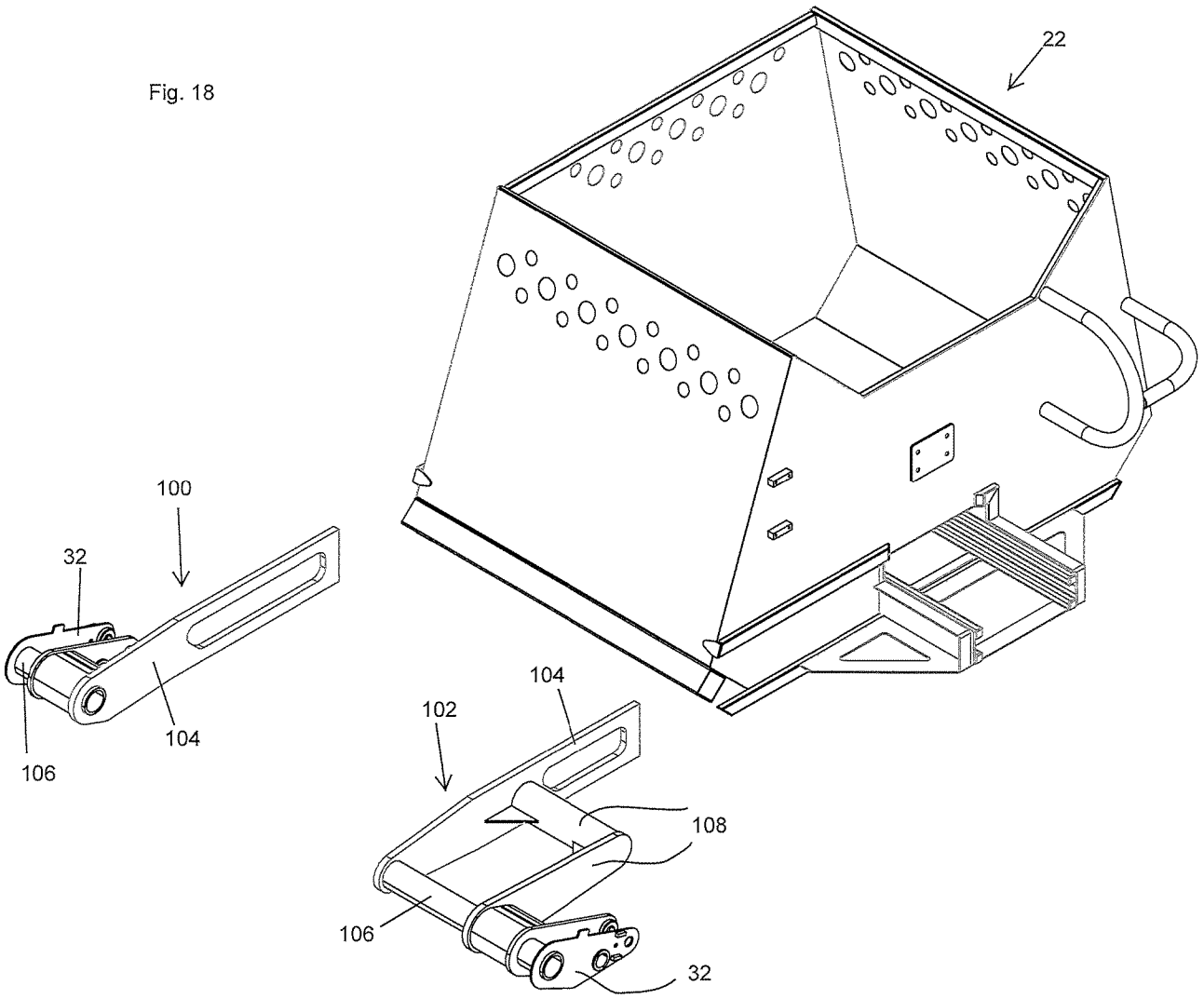
FIG. 18 is a rear perspective view similar to FIG. 17, except exploded for clarity.
Figure 19:
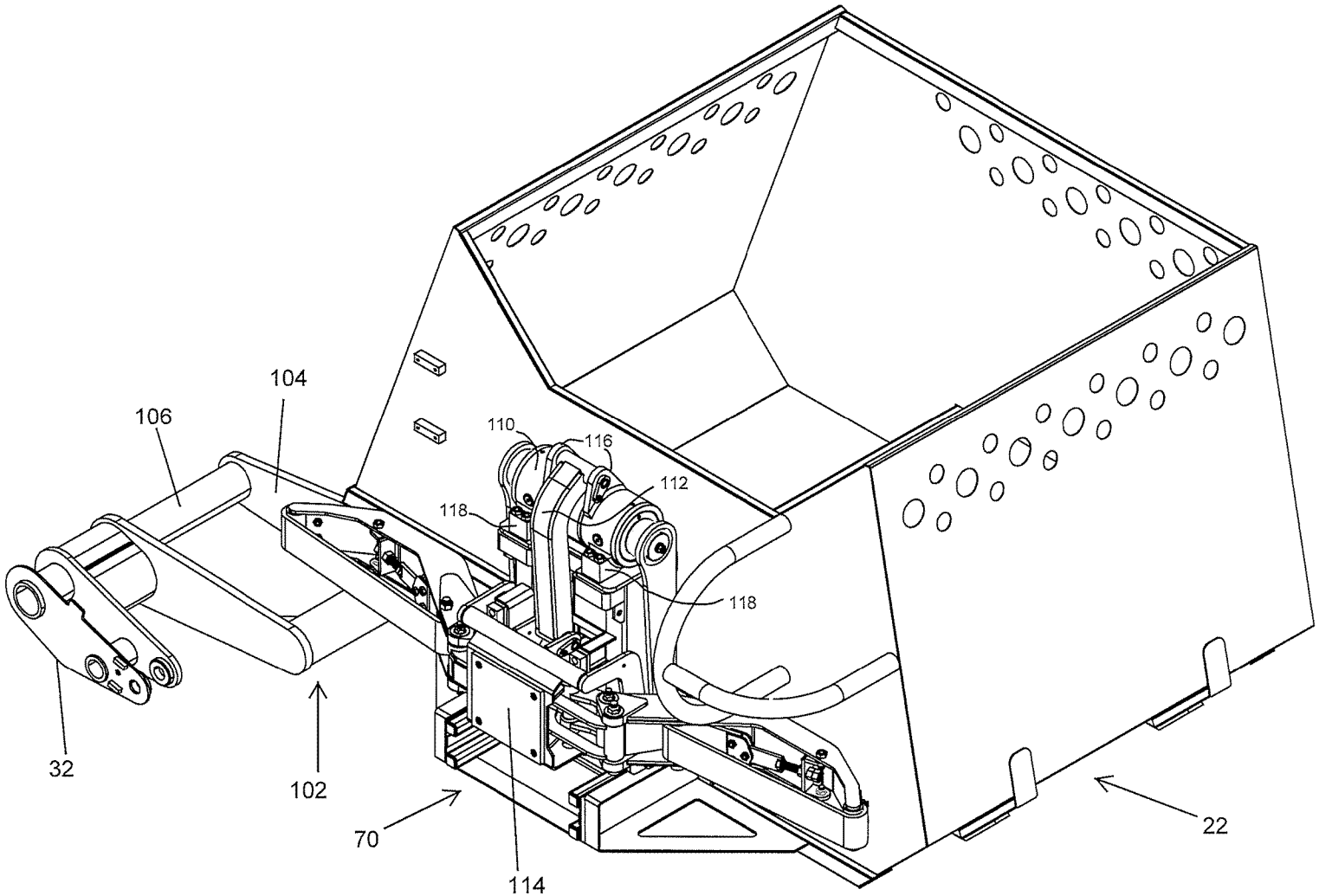
FIG. 19 is a front perspective view of the embodiment of FIG. 15 showing the primary refuse collection container lifter in a retracted, dumping position in which primary refuse collection container is inverted by the lifter for dumping its contents into the intermediate collection container.

As best seen in FIG. 13, the rigid extension member 52 has opposed side edges, each of which includes a roller channel 58. The track assembly has opposed side frames 60, each of which carries a plurality of rollers 62 and a self-lubricating guide block 64, each of which is received within a respective one of the roller channels 58. An openable access panel 66 is provided that defines a portion of the container bottom wall 42, such that at least a portion of the extension assembly 46 is located below the access panel 66.

A mounting base 68 is secured to the extension assembly 46 that is configured for mounting a primary refuse collection container lifter 70 thereon for engaging and dumping primary refuse containers into the intermediate container. Exemplary container lifters are shown in U.S. Pat. No. 7,390,159 and US 2011/0038697, which have the same assignee as the present application, and which are incorporated by reference herein. Any desired lifter, however, may be used.

In keeping with another aspect of the disclosure, the intermediate container 22 includes a plurality of spaced apart mounting members 44 for removably and non-destructively mounting the intermediate container 22 to lift arms 26 associated with the lift mechanism 20 of the refuse collection vehicle 12. The mounting members 44 extend generally rearwardly from the intermediate container 22, and are configured to engage mating connectors 72 (best seen in FIGS. 10, 11A and 11B, and described in greater detail below), so as to bring the mounting members 44 and connectors 72 into alignment as a collection vehicle 12 and the intermediate container 22 are moved into proximity during joinder.

As illustrated, the container mounting members 44 preferably extend at a diverging or converging angle (a converging angle being shown) relative to the rear wall 36 of the intermediate container 22. Preferably, the intermediate container 22 further includes a brace 74 extending rearwardly intermediate the container mounting members 44 that also provides for non-destructive removable attachment of the intermediate container 22 to the mounting system 24 of the collection vehicle 12.

In keeping with another aspect of the disclosure, the mounting system 24 is configured so as to be convertible to permit its use with either an intermediate collection container having fork receivers or an intermediate collection container without fork receivers. To this end, the mounting system 24 includes a cross member 76 that extends between and pivotally attaches to the lift arms 26 of the lift mechanism 20 for the collection vehicle 12. Spaced-apart mounting connectors 72 are fixedly attached to the cross member 76 (by, e.g., welding) and are configured for selective and non-destructive removable attachment to either forks for lifting an intermediate container having fork receivers, or to the mounting members of the intermediate container described above, which is free of fork receivers.

As Illustrated, the mounting connectors 72 comprise mounting plates that extend at an acute angle relative to the axis of the cross member 76. More specifically, the connectors 72 extend at a diverging angle for engagement with mounting members 44 that extend rearwardly for the collection container 22 at a converging angle. This arrangement helps align the vehicle and intermediate container as they are moved toward one another. To enhance the ease and strength of the connection, each mounting connector 72 preferably includes any suitable registration shape 78 for mating engagement with a complementary registration shape 80 on the respective intermediate container mounting member 44 or container fork 82. To this end, the mounting connectors 72, as specifically illustrated, have forward-facing saddles or concave recesses 78 for receiving raised circular bosses 80 that are integral with the container fork 82 or the mounting member 44 of the intermediate container 22. The cross member 76 further includes an attachment point 84 on the cross member 76 intermediate the mounting connectors 72 for attachment to the brace 74 that extends rearwardly from the intermediate container 22.

In addition, fastening assemblies, generally designated 86, are provided for non-destructively and removably attaching each mounting connector 72 to a container lift fork 82 or a mating connector 44 on the intermediate container 22. As illustrated, the fastening assemblies 86 are configured to attach a mounting member 44 and mounting connector 72 together in face to face relation by means of a plate 88 and a plurality of bolts 90 and nuts 92. The plate is generally u-shaped when viewed in cross-section, with opposed flanges which overlap the adjoining portions of the connectors 72 and members 44 to enhance rigidity when connected. The rigid connection of the intermediate container to the cross member by the mounting members 44 and brace 74 is believed to reduce shock and vibration that can occur during lifting and dumping when using vehicle forks and standard intermediate container using fork receivers.

As shown in FIGS. 1-9 and described above, the intermediate container 22 is removably connected to the cross member 76, which is carried between the ends of the lift arms 26 of the collection vehicle 12. With reference to FIGS. 15-20, an alternative means for removably attaching the intermediate container 22 to the lift arms 26 is shown. Specifically, the mounting system no longer includes an elongated cross member that extends between the ends of the lift arms. Instead, the intermediate container 22 includes a mounting member 100, 102 secured to each of the opposed sidewalls 38, 40 of the intermediate container.

Figure 20:
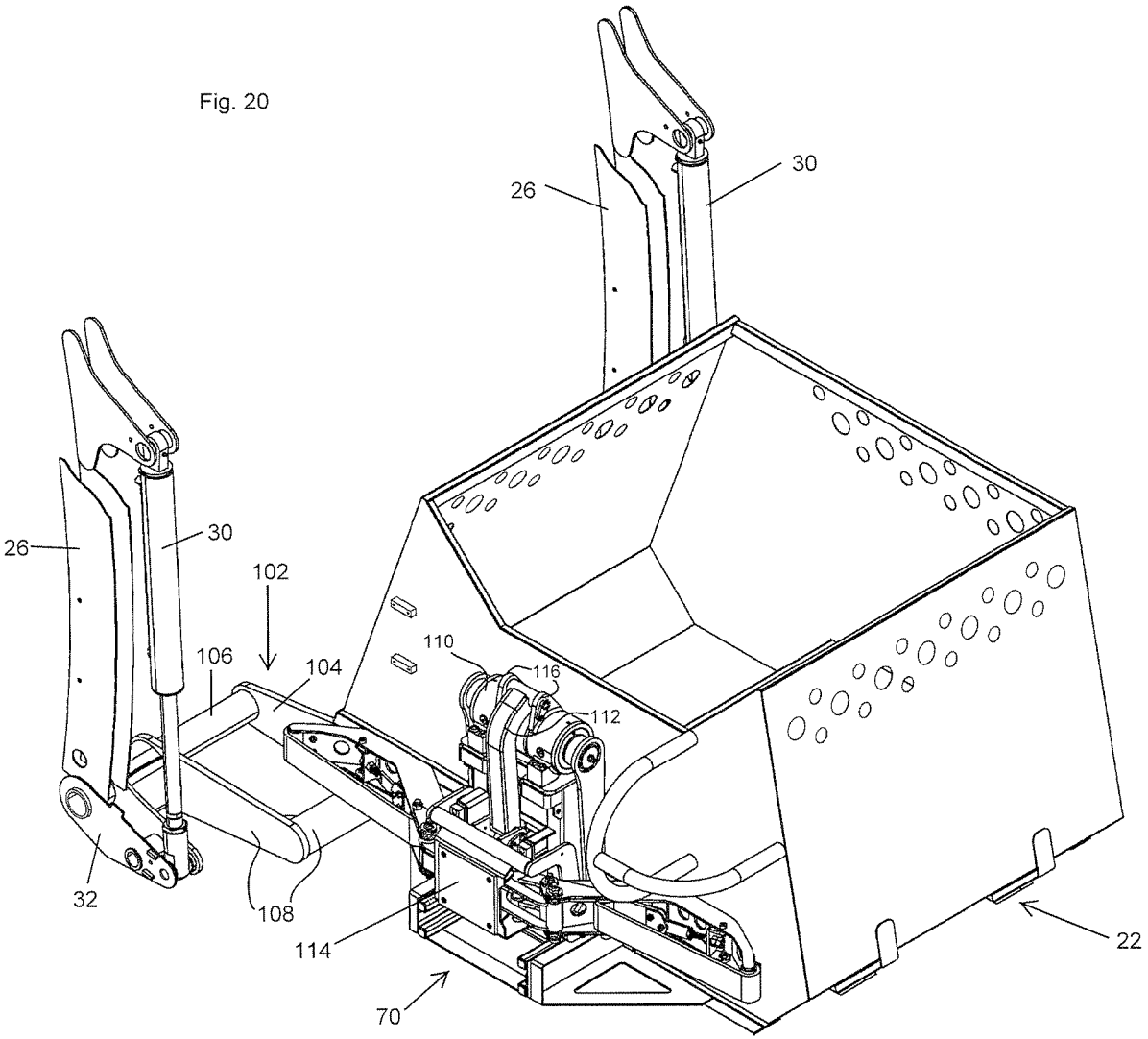
FIG. 20 is a front perspective view similar to FIG. 19 showing the intermediate container and its mounting system in combination with the lift arms of the refuse collection vehicle.

Each of the mounting members 100, 102 comprises an elongated arm 104 that is welded, or otherwise permanently secured to the container sidewall 38, 40, with each arm 104 extending rearwardly of the rear wall 36 of the container 22. Each arm 104 has an elongated cylindrical member 106 secured generally perpendicularly thereto, the end of which has the pivot arm 32 secured thereto and which is rotatably mounted to the end of its associated lift arm 26 (as shown in FIG. 20). Due to the length of the cylindrical member 106 associated with mounting member 102, additional bracing 108 is provided to further strengthen and rigidify the structure.

Figure 22:
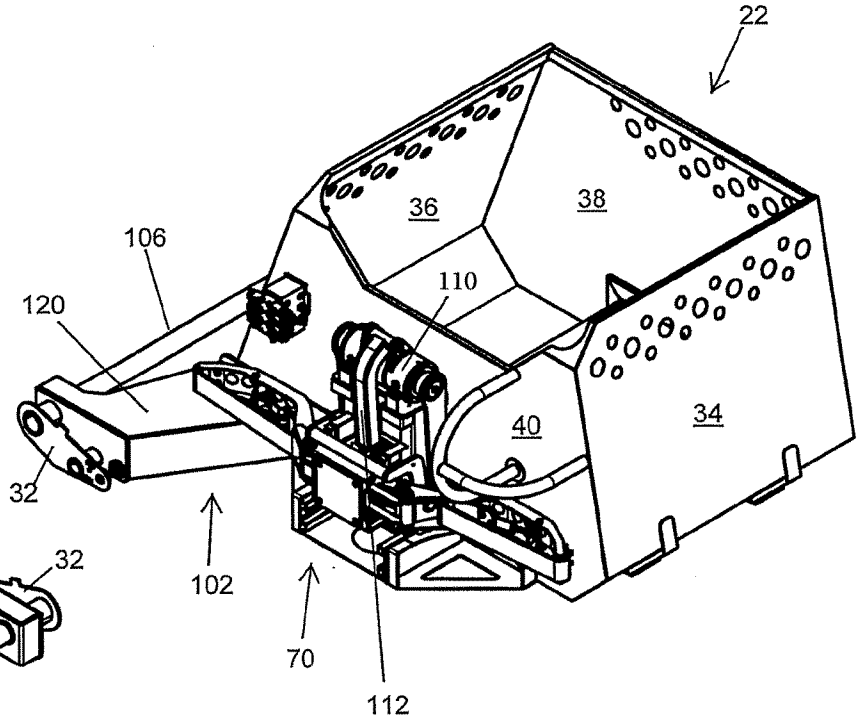
FIGS. 21 and 22 are rear and front perspective views, respectively, of a third embodiment of an intermediate container having a further alternative structure for removably securing the intermediate container to the lift arms of a refuse collection vehicle.
Figure 21:
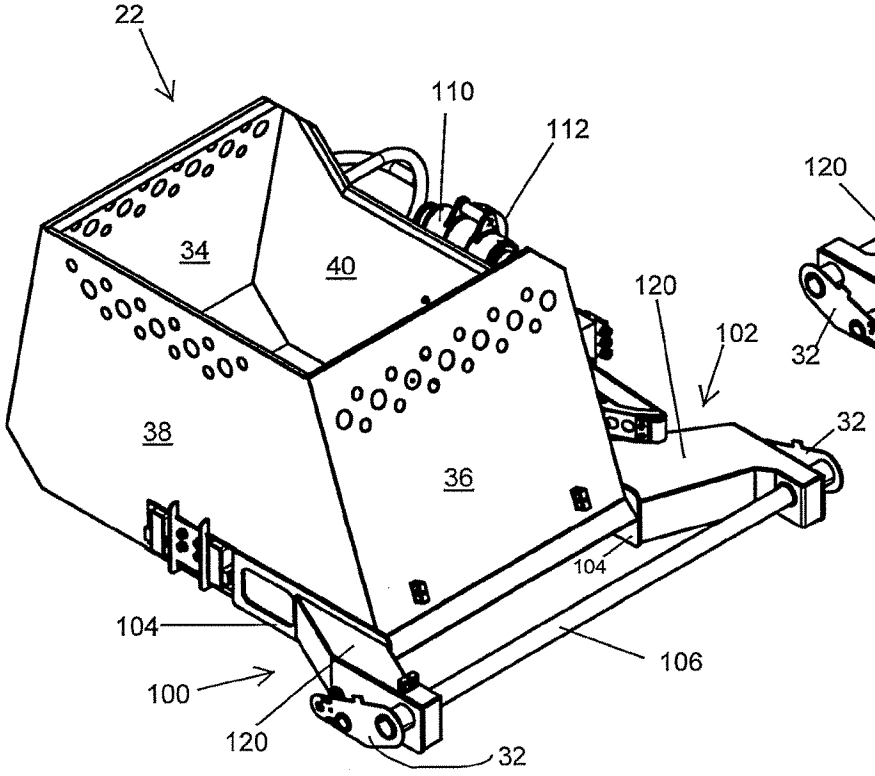

In a further alternative, shown in FIGS. 21 and 22, each of the mounting members 100, 102 comprises a box section 120 having a top wall, a bottom wall, and a plurality of side walls. The rearward portion of the elongated arms 104 extends to the rear wall 36 of the intermediate container 22 and forms one of the side walls of box sections 100, 102. The elongated cylinder 106 extends between the two box sections. The box sections provide for greater rigidity with a reduced total mass and are shaped without 90° bends, thus reducing stress risers in the mounting structure. Each end of the cylinder 106 is rotatably mounted to the end of its associated lift arm and has a pivot arm 32 secured thereto.

If a refuse collection vehicle that carries an intermediate container 22 that includes mounting members 100, 102, is to be converted to one suitable for use with intermediate containers having fork-receiving pockets, upon disconnecting the mounting members 100, 102 from the ends of the lift arms 26, a cross member 76 that carries removable forks 82, such as that shown in FIGS. 10 and 11B, may be secured between the ends of the lift arms 26. Alternatively, a conventional cross member having the forks permanently secured thereto (not shown) may be secured between the ends of the lift arms.

Through use of the mounting members 100, 102, the mounting structure is simplified and its weight reduced. Further weight savings may be realized by reconfiguration of the actuator 110 associated with the container lifter 70. A single central idler arm 112 may be substituted for two idler arm actuator used in the first embodiment, thus permitting the faceplate 114 of the lifter 70 to be narrower. The idler arm 112 is centrally mounted to the actuator and pivots on anchor lugs 116 incorporated into and integral with the body structure/housing of the actuator 110, thus eliminating the support structure that extended from the mounting base 68 of the first embodiment. Further, by having the mounting feet 118 of the actuator face downwardly, the mounting base 68 may be eliminated entirely.

The access panel 66 may also be eliminated to save weight in favor a fixed panel secured in place by, e.g., welding to provide a water-tight seal, with access to the extension assembly 46 for servicing provided from underneath the intermediate container. To simplify servicing, the rollers 60 and the self-lubricating guide blocks 64 may be secured to the extension member 52, rather than to the side frames 60 of the track (best seen in FIGS. 15 and 16).

The system described above thus provides for a method of refuse collection with a refuse collection vehicle that comprises non-destructively removably attaching intermediate container lift forks to the lift arms; lifting and dumping an intermediate collection container having fork receivers; non-destructively removing the container lift forks from the lift arms; and non-destructively removably attaching to the lift arms an intermediate container lacking fork receivers. This versatile arrangement allows the same refuse collection vehicle to be used with forks for dumping commercial refuse collection containers with fork receivers, such as encountered on commercial refuse collection routes, and then after conversion by removal of the forks and attachment of the intermediate collection contain, to be used for residential routes where refuse is collected from primary curb-side collection containers, and, if desired, converted by to the use forks for commercial routes, as needed by the waste hauler.

Thus, a new and unique arrangement for an intermediate refuse collection container has been provided, offering particular versatility for emptying, intermediate containers not found on prior systems. The foregoing description is intended to be illustrative, and is not intended to limit the invention to any specific system or device.

The invention claimed is:

1. An intermediate container for receiving refuse from a primary refuse container, and configured to be carried by a top-loading refuse collection vehicle having first and second lift arms pivotally attached to opposite sides of the refuse collection vehicle, the intermediate container comprising:

a) a front wall, a rear wall, opposed sidewalls, and a bottom wall defining a total refuse collection volume;

b) an extension assembly substantially beneath the total refuse collection volume intermediate the front wall and the rear wall, a portion of the extension assembly being configured for mounting a primary refuse collection container lifter thereon and movable between a first, retracted position for storage and for dumping a primary refuse collection container and a second, extended position for engaging and releasing the primary refuse collection container at a location laterally spaced from the intermediate container refuse collection vehicle; and c) the intermediate container being free of fork receivers and including first and second mounting members permanently secured to the opposed sidewalls for attachment to first and second lift arms of the refuse collection vehicle, each of the first and second mounting members extending rearwardly of the rear wall of the container and having an elongated cylindrical member secured thereto and configured to be rotatably mounted to the first and second lift arms of the refuse collection vehicle.

2. The intermediate container of claim 1 wherein the elongated cylindrical member extends between the first and second mounting members.

3. The intermediate container of claim 1 wherein each of the first and second mounting members comprises an elongated, planar arm secured to its respective sidewall of the intermediate container.

4. The intermediate container of claim 3 wherein each planar arm includes a portion that extends to the rear wall of the intermediate container and comprises a side wall of a box section extending rearwardly of the rear wall of the intermediate container and through which the elongated cylindrical member extends.

5. The intermediate container of claim 4 wherein each box section comprises a top wall, a bottom wall, and a plurality of side walls.

6. The intermediate container of claim 1 further comprising a pivot arm secured to opposite ends of the elongated cylindrical member for attachment to an actuator associated with each of the first and second lift arms of the refuse collection vehicle.

7. The intermediate container of claim 1 further comprising a primary refuse collection container lifter secured to the extension member, the primary refuse collection container lifter comprising an actuator having a housing and single central idler arm centrally mounted to the housing by a pair of lugs integral with and extending from the housing.

8. The intermediate container of claim 1 wherein the extension assembly further comprises a track assembly with first and second side frames horizontally spaced-apart along the bottom wall of the intermediate refuse collection container, a rigid extension member with first and second spaced-apart slide members, a slide member being associated with each side frame, and an actuator positioned between the slide members for moving the rigid extension member relative to the track assembly.

9. An intermediate container for receiving refuse from a primary refuse container, and configured to be carried by a top-loading refuse collection vehicle lifter, the intermediate container comprising:

a) a front wall, a rear wall, opposed sidewalls, and a bottom wall defining a total refuse collection volume;

b) an extension assembly substantially beneath the total refuse collection volume intermediate the front wall and the rear wall, a portion of the extension assembly being movable between a first, retracted position for storage and for dumping a primary refuse collection container and a second, extended position for engaging and releasing the primary refuse collection container at a location laterally spaced from the intermediate container refuse collection vehicle;

c) a primary refuse collection container lifter secured to the extension assembly; and d) the intermediate container being free of fork receivers and including first and second mounting members permanently secured to the opposed sidewalls for non-destructive removable attachment to the collection vehicle lifter, each of the first and second mounting members comprising a portion extending rearwardly of the rear wall of the container and having an elongated cylindrical member secured perpendicularly thereto and configured to be rotatably mounted to the refuse collection vehicle.

10. The intermediate container of claim 9 wherein the primary refuse collection container lifter comprises an actuator having a housing and single central idler arm centrally mounted to the housing by a pair of lugs integral with and extending from the housing.

11. The intermediate container of claim 9 wherein the extension assembly further comprises a track assembly with first and second side frames horizontally spaced-apart along the bottom wall of the intermediate refuse collection container, a rigid extension member with first and second spaced-apart slide members, a slide member being associated with each side frame, and an actuator positioned between the slide members for moving the rigid extension member relative to the track assembly.

12. A refuse collection system comprising:

a) a top-loading refuse collection vehicle having first and second lift arms pivotally attached to opposite sides of the refuse collection vehicle; and b) an intermediate container for receiving refuse from a primary refuse container, the intermediate container comprising:

i) a front wall, a rear wall, opposed sidewalls, and a bottom wall defining a total refuse collection volume;

ii) an extension assembly substantially beneath the total refuse collection volume intermediate the front wall and the rear wall, a portion of the extension assembly being configured for mounting a primary refuse collection container lifter thereon and movable between a first, retracted position for storage and for dumping a primary refuse collection container and a second, extended position for engaging and releasing the primary refuse collection container at a location laterally spaced from the intermediate container refuse collection vehicle; and iii) the intermediate container being free of fork receivers and including first and second mounting members permanently secured to the opposed sidewalls for attachment to first and second lift arms of the refuse collection vehicle, each of the first and second mounting members extending rearwardly of the rear wall of the container and having an elongated cylindrical member secured thereto and configured to be rotatably mounted to the first and second lift arms of the refuse collection vehicle.

13. The intermediate container of claim 12 wherein the elongated cylindrical member extends between the first and second mounting members.

14. The intermediate container of claim 12 wherein each of the first and second mounting members comprises an elongated, planar arm secured to its respective sidewall of the intermediate container.

15. The intermediate container of claim 14 wherein each planar arm includes a portion that extends to the rear wall of the intermediate container and comprises a side wall of a box section extending rearwardly of the rear wall of the intermediate container and through which the elongated cylindrical member extends.

16. The intermediate container of claim 15 wherein each box section comprises a top wall, a bottom wall, and a plurality of side walls.

17. The intermediate container of claim 12 further comprising a pivot arm secured to opposite ends of the elongated cylindrical member for attachment to an actuator associated with each of the first and second lift arms of the refuse collection vehicle.

18. The intermediate container of claim 12 further comprising a primary refuse collection container lifter secured to the extension member, the primary refuse collection container lifter comprising an actuator having a housing and single central idler arm centrally mounted to the housing by a pair of lugs integral with and extending from the housing.

19. The refuse collection system of claim 12 wherein the extension assembly of the intermediate container further comprises a track assembly with first and second side frames horizontally spaced-apart along the bottom wall of the intermediate refuse collection container, a rigid extension member with first and second spaced-apart slide members, a slide member being associated with each side frame, and an actuator positioned between the slide members for moving the rigid extension member relative to the track assembly.

* * * * *